US011522290B1

(12) United States Patent
Ma et al.

(10) Patent No.: US 11,522,290 B1
(45) Date of Patent: Dec. 6, 2022

(54) PRINTED CIRCUIT BOARD ANTENNAS

(71) Applicant: Hewlett-Packard Development Company, L.P., Spring, TX (US)

(72) Inventors: Chin-Hung Ma, Taipei (TW); Ruei-Ting Miau, Spring, TX (US); Po Chao Chen, Taipei (TW); Yung-Chang Wei, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/363,076

(22) Filed: Jun. 30, 2021

(51) Int. Cl.
*H01Q 1/22* (2006.01)
*H01Q 9/04* (2006.01)

(52) U.S. Cl.
CPC ..... *H01Q 9/0414* (2013.01); *H01Q 1/2266* (2013.01); *H01Q 1/2283* (2013.01); *H01Q 1/2291* (2013.01)

(58) Field of Classification Search
CPC ..... H01Q 9/0414; H01Q 1/2266
USPC ..... 343/702
See application file for complete search history.

(56) References Cited

U.S. PATENT DOCUMENTS

| | | | | |
|---|---|---|---|---|
| 6,778,139 | B2 | 8/2004 | Suzuki | |
| 7,417,596 | B2 | 8/2008 | Zellweger | |
| 9,250,613 | B2 | 2/2016 | Jenwatanavet | |
| 10,218,066 | B2 * | 2/2019 | Su | H01Q 1/243 |
| 2014/0269217 | A1 | 9/2014 | Jenwatanavet | |
| 2017/0125889 | A1 | 5/2017 | Pascolini | |
| 2018/0358686 | A1 | 12/2018 | Park | |

* cited by examiner

*Primary Examiner* — Peguy Jean Pierre
(74) *Attorney, Agent, or Firm* — HPI Patent Department

(57) ABSTRACT

In an example, an electronic device may include a housing and a display panel disposed in the housing. Further, the electronic device may include an input assembly disposed in the housing abutting a side of the display panel. The input assembly may include a printed circuit board (PCB), a sensor disposed on the PCB, and a first keep-out zone defined on the PCB on a side of the sensor. Further, the electronic device may include an antenna disposed in the first keep-out zone of the PCB.

19 Claims, 6 Drawing Sheets

PRINTED CIRCUIT BOARD ANTENNAS

BACKGROUND

The emergence and popularity of mobile computing has made portable electronic devices, due to their compact design and light weight, a staple in today's marketplace. An example electronic device may include a notebook computer, a laptop computer, a personal digital assistant, and the like. Due in part to their mobile nature, such electronic devices may often be equipped with wireless communication devices for wireless wide area network (WWAN), wireless local area network (WLAN), and the like. In such electronic devices, various radio access technologies are combined into a small form factor. For example, different radio access technologies may be used to simultaneously allow a user to engage in different forms of wireless communication activities. The radio access technologies may incorporate multiple antennas to support various wireless subsystems and communications.

BRIEF DESCRIPTION OF THE DRAWINGS

Examples are described in the following detailed description and in reference to the drawings, in which.

DETAILED DESCRIPTION

Figure 1A:
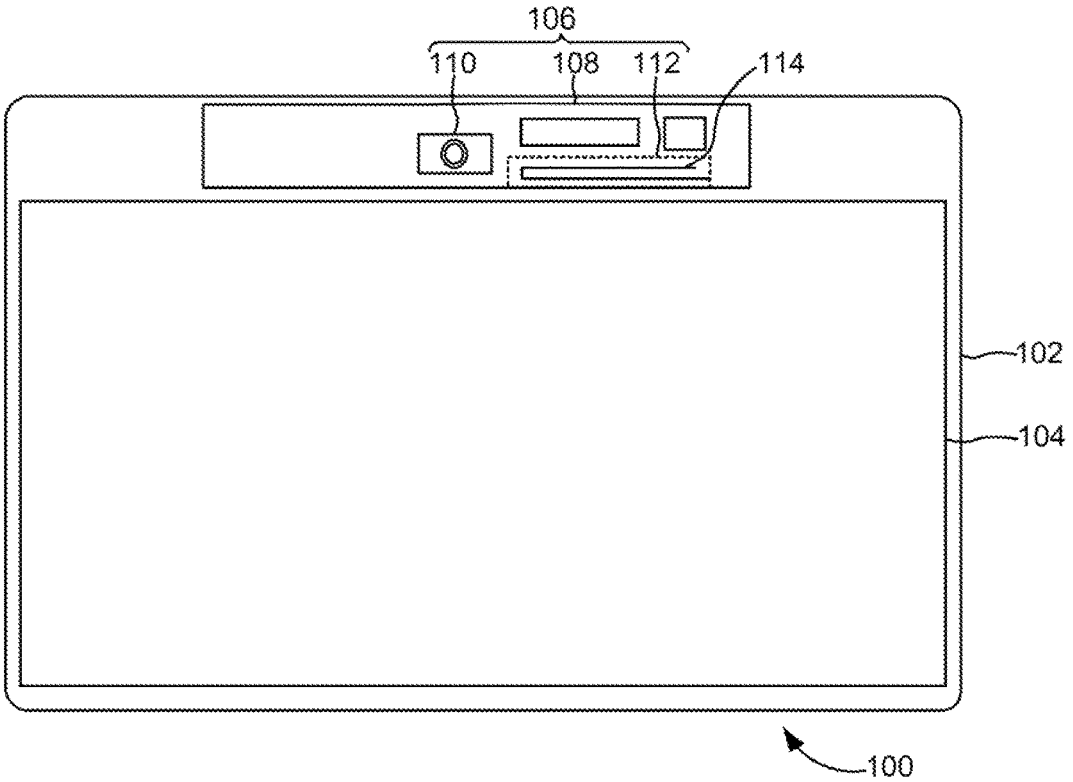
FIG. 1A is a cross-sectional front view of an example electronic device, depicting a printed circuit board (PCB) having a sensor and a first keep-out zone.

As mobile computing infrastructure evolves to enable electronic devices to transmit and receive significant amount of data while on the move, the abilities of the electronic devices to receive and transmit various signals simultaneously increase in demand. The electronic devices may employ multiple radio devices for communication via wireless links operating on a variety of radio access technologies. For example, an electronic device may employ separate radio devices for wireless wide area network (WWAN) signals and wireless local area network (WLAN) signals.

Example WWAN signals may include 2G standards such as global system for mobile communications (GSM), 2.5G standards such as general packet radio service (GPRS), 3G standards such as wideband code-division multiple access (W-CDMA), 4G standards such as long-term evolution (LTE), emerging 5G standards, or worldwide interoperability for microwave access (WiMAX), small cell WWAN, and the like. Example WLAN signals may include wireless links adhering to standards such as, for example, wireless fidelity (Wi-Fi), wireless gigabit alliance (WiGig), and/or wireless personal area network (WPAN). In other examples, several radio devices may be available for each radio access technology to enable aggregated data communications such as via plural multiple in, multiple out (MIMO) streams to enhance bandwidth or reliability.

Such electronic devices may include multiple antennas to communicate with multiple different wireless networks. An antenna may be a device that emits or receives radio waves. The antenna may be used with a transmitter of a radio device. The transmitter may generate a radio signal, which may be an alternating current. The antenna may emit the radio signal as electromagnetic energy termed radio waves. The antenna may also be used with a receiver of the radio device. The receiver may receive a radio signal from the antenna and convert the information carried by the radio signal into a usable form. The radio device including both the transmitter and the receiver may be termed as a transceiver.

For example, the electronic device, such as a laptop, may include a WWAN antenna to communicate with a wide area network (WAN) and a WLAN antenna to communicate with a local area network (LAN). Other example antennas may include cellular antennas, wireless fidelity (Wi-Fi) antennas, Bluetooth antennas, global navigation satellite system (GNSS) antennas, and/or near field communication (NFC) antennas.

The electronic devices may include a display housing and a base housing pivotally, detachably, or twistably connected to the display housing. The antennas may be disposed as a fixed component either in the display housing or in the base housing. The placement of the antennas may enhance the antenna performance. For example, the reception and transmission capabilities of the antennas may change based on the placement and/or surroundings of the antennas. To place an antenna in the electronic device, various factors may have to be considered, i.e., an antenna dimension, keep-out area, grounding, and the like. Based on these factors, a significant amount of space may have to be reserved in the electronic device in order to place multiple antennas.

An example 5G antenna implementation may involve an additional 4 antennas (e.g., two 5G millimeter wave antennas and two 5G sub-6 GHz antennas) along with two or four LTE WWAN (4G) antennas and two WLAN antennas. In such examples, configurations involving multiple radio devices operating on a variety of radio access technologies may encounter problems associated with radio frequency interference (RFI). For example, the electronic devices may include devices, e.g., processors, clocks circuits, and/or wireless devices, which may cause the RFI. RFI signals that may have escaped from within the electronic device may be picked up by an antenna and may cause the interference to a transceiver that is coupled to the antenna. The RFI may reduce the performance (i.e., throughput) of the radio devices.

To avoid the RFI, a top border area or a bezel portion of the display housing may be preferred for the antenna placement. However, the top border area may be occupied by an input assembly (e.g., a microphone module that includes a microphone, a camera module that includes a camera, or a camera-microphone module that includes a camera, a microphone, a depth sensor, and/or other components). In such cases, the input assembly may incorporate the components (i.e., the camera, the microphone, the depth sensor, and/or the like) on a printed circuit board (PCB). However, in some example scenarios, the bezel portion in which the PCB is disposed may have an additional unused space, for instance, above or below the PCB (e.g., in a Y-direction). For example, the unused space may be created above the PCB by a mechanical camera shutter disposed above the camera.

Examples described herein may provide an electronic device including a display panel. The display panel may include a display area and a peripheral area abutting on a side of the display area. Further, the electronic device may include an input assembly (e.g., a microphone module, a camera module, a camera and microphone module, or the like) disposed in the peripheral area. The input assembly may include a PCB, a sensor (e.g., a camera, a depth sensor, and/or the like) disposed on the PCB, and an electronic component (e.g., a microphone) disposed on the PCB on a side of the sensor. Further, the PCB may define a keep-out zone above or below the electronic component. Furthermore, the electronic device may include an antenna disposed in the keep-out zone.

In another example, the PCB may include a recess portion above the sensor. In this example, the electronic device may include a slidable shutter mounted to a housing of the electronic device in the recess portion. Thus, examples described herein may utilize an unused space created by the slidable shutter above the PCB to elevate the input assembly in the Y-direction, and to define the keep-out zone on the PCB.

In the following description, for purposes of explanation, numerous specific details are set forth in order to provide a thorough understanding of the present techniques. However, the example apparatuses, devices, and systems, may be practiced without these specific details. Reference in the specification to "an example" or similar language means that a particular feature, structure, or characteristic described may be included in at least that one example but may not be in other examples.

Turning now to the figures, FIG. 1A is a cross-sectional front view of an example electronic device 100, depicting a printed circuit board (PCB) 108 having a sensor 110 and a first keep-out zone 112. Example electronic device 100 may include a laptop computer, a notebook computer, a tablet computer, a smartphone, or the like. As shown in FIG. 1A, electronic device 100 may include a housing 102, a display panel 104 disposed in housing 102, and an input assembly 106 disposed in housing 102 abutting a side of display panel 104. In another example, electronic device 100 may include a display region and a non-display region. The non-display region may be covered by a bezel of housing 102 or a display layer (e.g., a front glass) of display panel 104. In this example, input assembly 106 may be disposed in an upper bezel region that abuts a top side of the display region.

Further, input assembly 106 may include PCB 108. In an example, PCB 108 may be used to mechanically support and electrically connect electronic components (e.g., a camera, a depth sensor, a microphone, and/or the like) using conductive pathways, tracks, or signal traces etched from copper sheets laminated onto a non-conductive substrate. Furthermore, input assembly 106 may include sensor 110 disposed on PCB 108. In an example, sensor 110 may be an audio capturing device, a video capturing device, a still image capturing device, or the like. Example sensor 110 may include a camera, a depth sensor, a microphone, or the like.

Furthermore, input assembly 106 may include first keep-out zone 112 defined on PCB 108 on a side of sensor 110. The term "keep-out zone" may be defined as an area around an antenna where no copper traces or ground fill can be used on any layer of a PCB. In an example, first keep-out zone 112 may be defined on PCB 108 above or below sensor 110. Further, electronic device 100 may include an antenna 114 disposed in first keep-out zone 112 of PCB 108. Antenna 114 may be a device that emits or receives radio waves. Antenna 114 may be used with a transceiver.

In an example, antenna 114 may be a surface mount antenna that can be disposed or formed on PCB 108. In another example, antenna 114 can be integrated in PCB 108. In yet another example, antenna 114 may be a PCB antenna that includes another PCB and a trace drawn onto the other PCB. In this example, the other PCB may be disposed in first keep-out zone 112 of PCB 108. Example antenna 114 may be a PCB trace antenna, a patch antenna, a chip antenna, a dipole antenna, a monopole antenna, a loop antenna, microstrip antenna, or any other type of antenna suitable for transmission of radio frequency signals. An example PCB trace antenna may include a trace laminated on a surface of a PCB or, in some examples, traces that can occupy several layers of a multilayer PCB, and the traces on each layer may be interconnected. Antenna 114 may include a C shape, an inverted-C shape, or any other shape that can fit in first keep-out zone 112.

In yet another example, electronic device 100 may define a space between PCB 108 and display panel 104. in this example, antenna 114 (e.g., a PCB antenna) may be disposed in the space between PCB 108 and display panel 104. Thus, examples described in FIG. 1A may enable an additional antenna (i.e., antenna 114) to be placed in the non-display region by combining antenna 114 with input assembly 106.

Figure 1B:
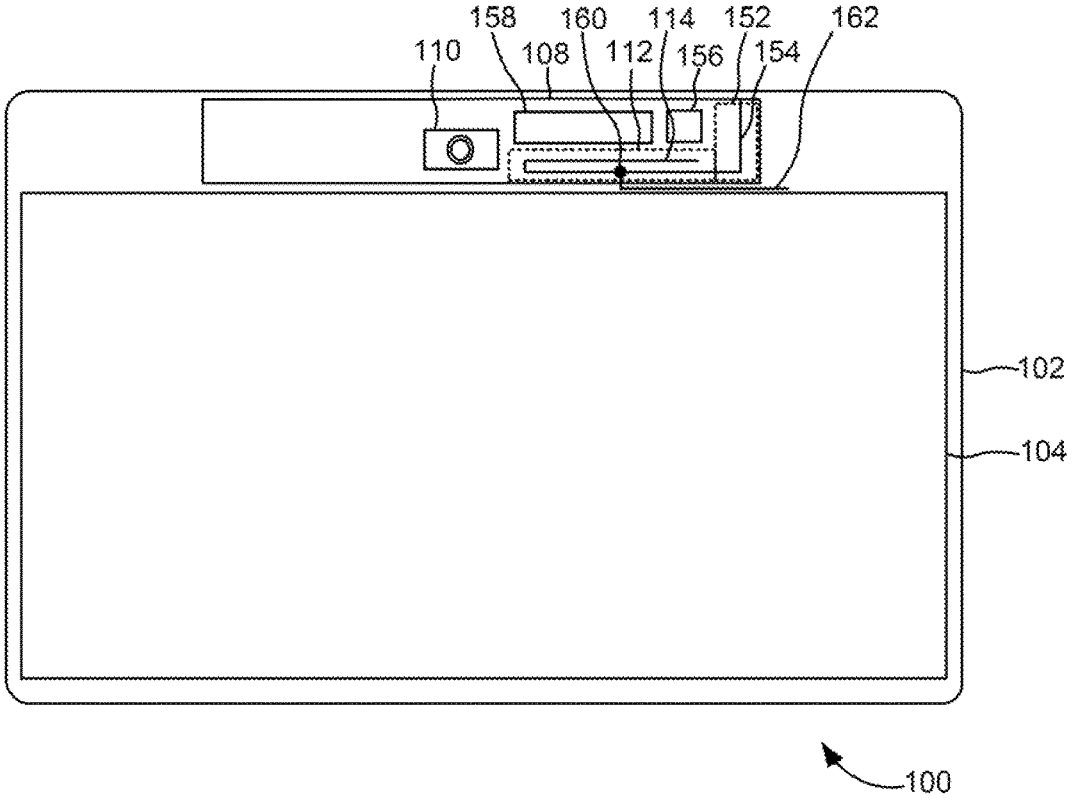
FIG. 1B is a cross-sectional front view of the example electronic device of FIG. 1A, depicting additional features.

FIG. 1B is a cross-sectional front view of example electronic device 100 of FIG. 1A, depicting additional features. For example, similarly named elements of FIG. 1B may be similar in structure and/or function to elements described with respect to FIG. 1A. As shown in FIG. 1B, electronic device 100 may include a second keep-out zone 152 defined on PCB 108. In an example, second keep-out zone 152 may abut a portion of first keep-out zone 112 and may be defined perpendicular to first keep-out zone 112. Further, electronic device 100 may include a radiator 154 disposed in second keep-out zone 152 and connected to antenna 114 to extend a size of antenna 114.

For example, an antenna trace for antenna 114 may be formed in first keep-out zone 112 and second keep-out zone 152 based on a design of antenna 114. In some examples, the design of antenna 114 may have to include an electrical length of about ¼ wavelength of an application frequency. When first keep-out zone 112 is not sufficient to realize a desired wavelength, then radiator 154 disposed in second keep-out zone 152 can be used to extend the size of antenna 114. Radiator 154 may facilitate in radiating radio waves. An example radiator may refer to a part of an antenna, which is made of electrically conductive material such as metal (e.g., copper). For example, radiator 154 may have a patch-shape, a T-shape, L-shape, inverted L-shape, inverted F-shape, or any other shape that radiates and receives radio waves. Example radiator 154 may include a PCB trace.

Further, input assembly 106 (e.g., as shown in FIG. 1A) may include an electronic component 156 disposed on PCB 108 on a side of sensor 110. For example, sensor 110 may be a camera and electronic component 156 may be a microphone disposed on a left side or a right side of sensor 110. In this example, first keep-out zone 112 may be defined on PCB 108 abutting a side of display panel 104, electronic component 156, and sensor 110. Thus, examples described in FIGS. 1A and 1B may define a first portion, a second portion, and a third portion on a surface of PCB 108 to accommodate sensor 110, electronic component 156, and antenna 114, respectively, thereby effectively utilizing a space on PCB 108.

Further, PCB 108 may include an electromagnetic interference (EMI) shield 158 disposed around sensor 110 to shield sensor 110 from a radio frequency interference (RFI). The term "around" sensor 110 may refer to providing a conductive path at or above sensor 110, at or below sensor 110, at a left side of sensor 110, at a right side of sensor 110, or any combination thereof. The conductive path may be formed by a conductive element.

Further, electronic device 100 may include an antenna feed 160 disposed on PCB 108 and electrically connected to antenna 114. In an example, antenna feed 160 may be a location on antenna 114, where a feedline 162 from antenna feed 160 is connected. Feedline 162 may refer to a transmission line connected between antenna 114 and the transceiver. During operation, antenna feed 160 may feed the radio waves to various components of antenna 114. In other examples, feedline 162 may also include a shied line to electrically connect antenna 114 to a system ground associated with electronic device 100.

Figure 2A:
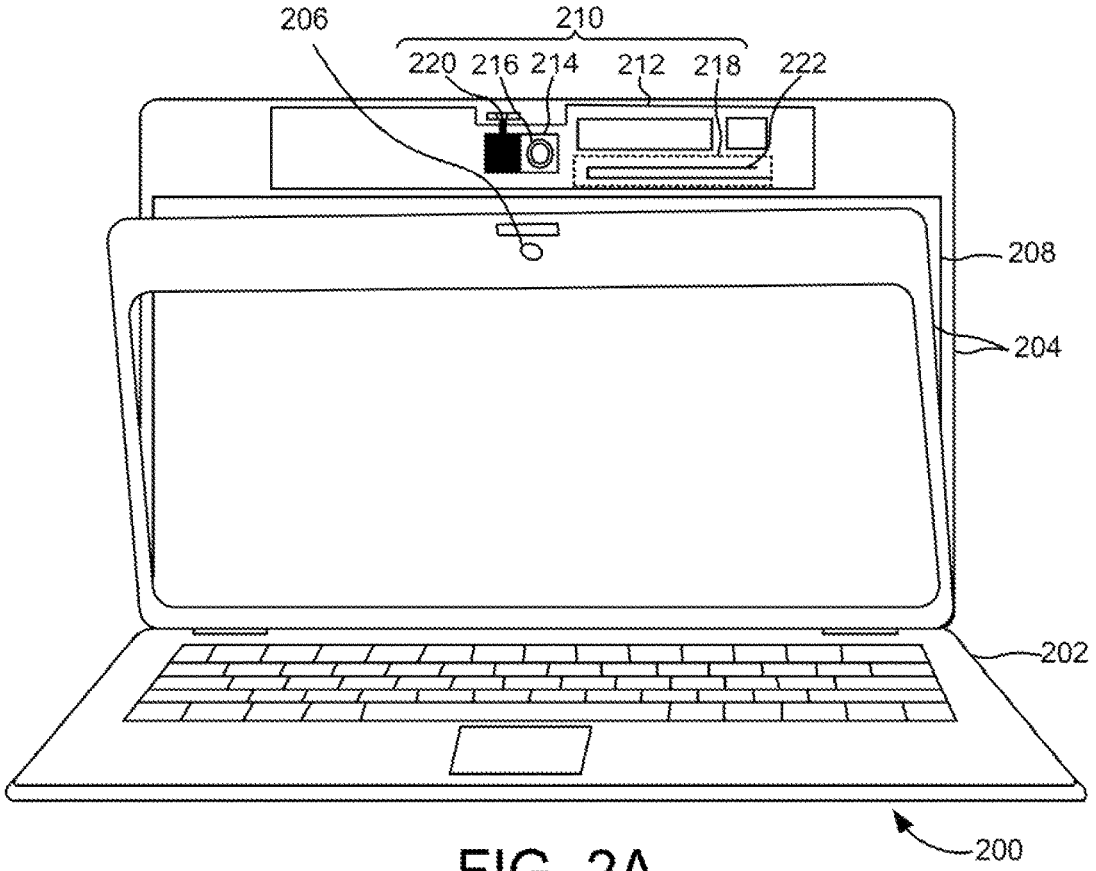
FIG. 2A is a schematic front view of another example electronic device, depicting a PCB having a camera and a keep-out zone.

FIG. 2A is a schematic front view of another example electronic device 200, depicting a PCB 212 having a camera 214 and a keep-out zone 218. Electronic device 200 may include a base housing 202 and a display housing 204 connected to base housing 202. For example, base housing 202 may house a keyboard, a battery, a touchpad, and so on and display housing 204 may include a display panel 208. In other examples, display housing 204 and base housing 202 may house other components depending on the functions of electronic device 200.

Figure 2B:
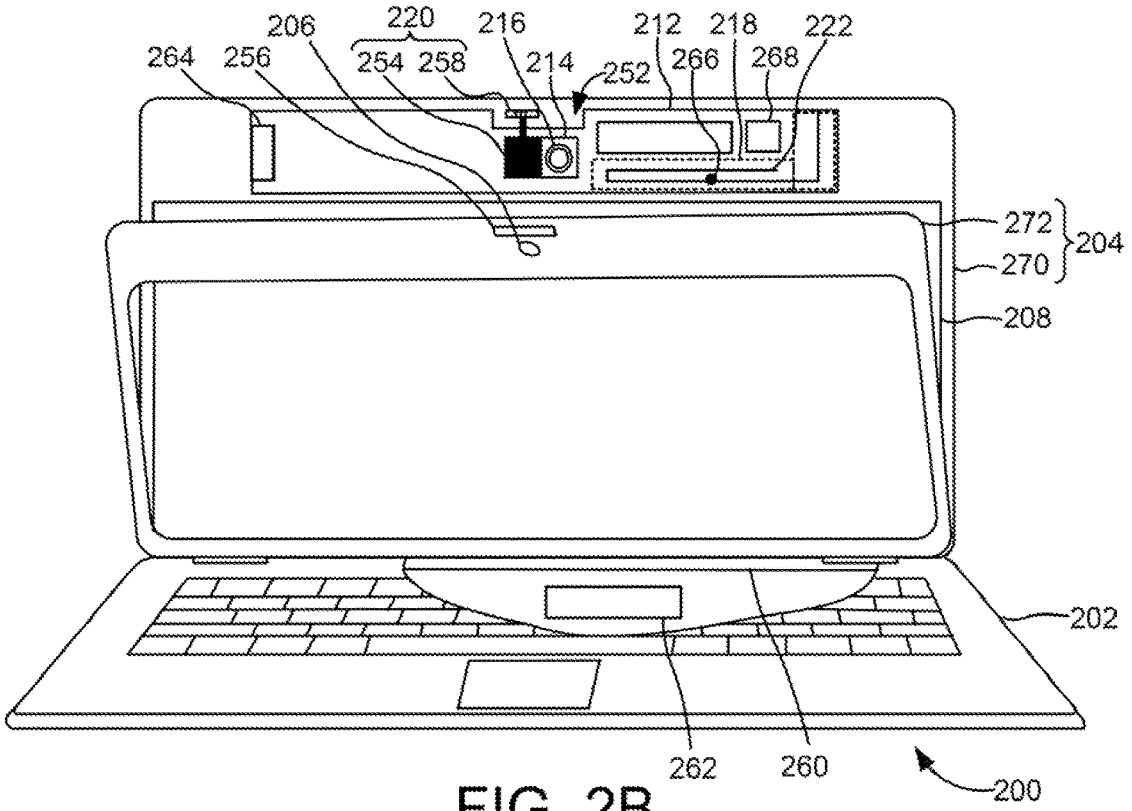
FIG. 2B is a schematic front view of the example electronic device of FIG. 2A, depicting additional features.

Display housing 204 may define an opening 206. In an example, display housing 204 may include a casing (e.g., a casing 270 as shown in FIG. 2B) at a first side and a bezel (e.g., a bezel 272 as shown in FIG. 2B) at a second side. Bezel 272 can be attached to casing 270 to hold display panel 208. In this example, opening 206 may be defined in bezel 272.

Further, display housing 204 may include an input assembly 210. Input assembly 210 may include PCB 212 abutting a side of display panel 208. Further, input assembly 210 may include camera 214 disposed on PCB 212. In an example, camera 214 may be positioned to image a space in front of display panel 208 within a field of view. Further, camera 214 may include a lens 216 that aligns with opening 206.

Further, input assembly 210 may include keep-out zone 218 defined on PCB 212 on a side of camera 214. Input assembly 210 may include a slidable shutter 220 disposed between display housing 204 and lens 216. Slidable shutter 220 may be moved between a closed position where light may be blocked from entering lens 216 and an open position where light may be allowed from entering lens 216. In the closed position, slidable shutter 220 may obscure the field of view of camera 214. Further, display housing 204 may include an antenna 222 formed in keep-out zone 218.

FIG. 2B is a schematic front view of example electronic device 200 of FIG. 2A, depicting additional features. For example, similarly named elements of FIG. 2B may be similar in structure and/or function to elements described with respect to FIG. 2A. As shown in FIG. 2B, PCB 212 may include a recess portion 252 defined above camera 214. In this example, slidable shutter 220 may be mounted to display housing 204 corresponding to recess portion 252.

Further, slidable shutter 220 may include a shielding portion 254 to slide between a closed position that impedes light from passing through opening 206 and an open position that allows the light to pass through opening 206. Furthermore, display housing 204 may include a shutter control opening 256. In this example, slidable shutter 220 may include a button portion 258 slidably mounted in shutter control opening 256 of display housing 204 above camera 214. In an example, button portion 258 may be formed above camera 214. Button portion 258 may enable (e.g., a user) to move shielding portion 254 between the closed position and the open position.

Furthermore, electronic device 200 may include a motherboard 260 disposed in base housing 202. Electronic device 200 may include a transceiver 262 disposed in base housing 202 and connected to motherboard 260. Electronic device 200 may include a connector 264 disposed on PCB 212 to electrically connect input assembly 210 (e.g., as shown in FIG. 2A) to motherboard 260. Further, electronic device 200 may include an antenna feed 266 disposed on PCB 212 to electrically connect antenna 222 to transceiver 262.

Further, input assembly 210 may include an electronic component 268 (e.g., a microphone) disposed on PCB 212 on a side of camera 214. In this example, keep-out zone 218 may be defined on PCB 212 between display panel 208 and electronic component 268. Further, display housing 204 may include casing 270 and bezel 272 that can be attached to casing 270 to hold display panel 208. In the example shown in FIG. 2B, bezel 272 may be detached from casing 270 to depict input assembly 210, keep-out zone 218, antenna 222, and the like. Since button portion 258 is mounted to display housing 204 above camera 214, an additional unused space may be created on a top side of PCB 212. Examples described herein may utilize the unused space to extend PCB 212 in the Y-direction (i.e., along a height of display housing 204). Further, extended PCB 212 may then be used to arrange the components (e.g., electronic component 268, camera 214, and the like) such that PCB 212 can accommodate keep-out zone 218.

Figure 3A:
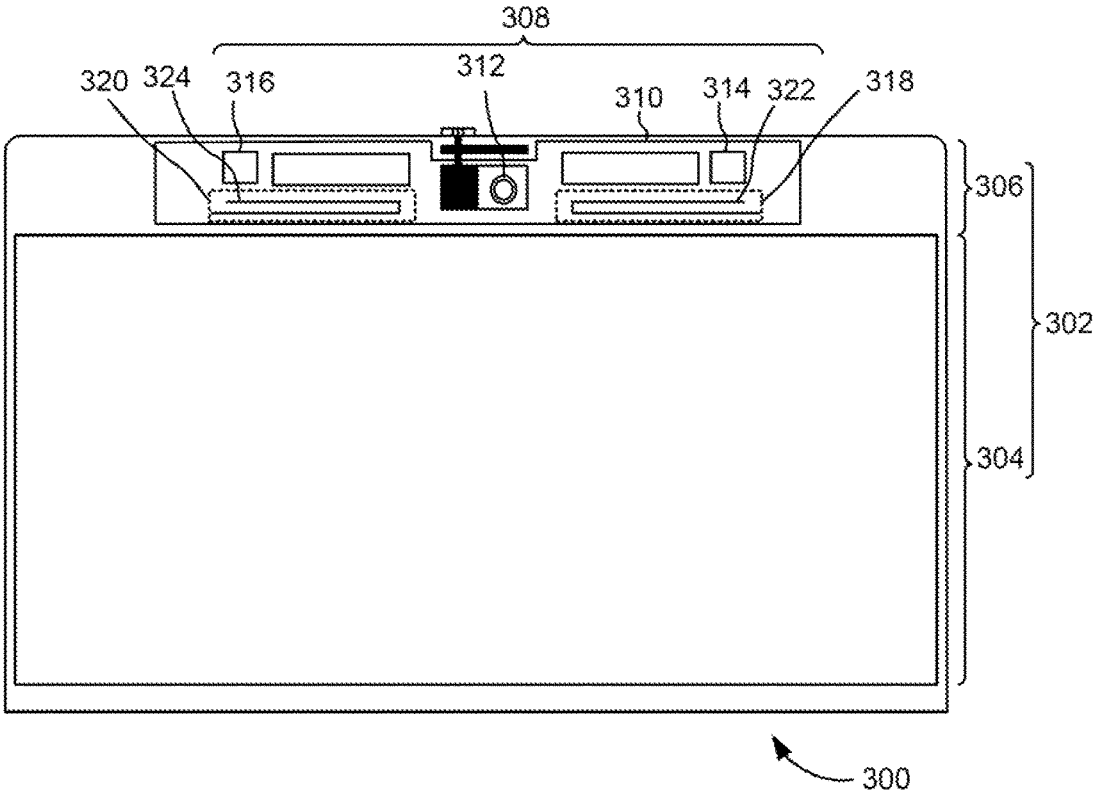
FIG. 3A is a cross-sectional front view of yet another example electronic device, depicting a first PCB having a camera, a first keep-out zone, and a second keep-out zone.

FIG. 3A is a cross-sectional front view of yet another example electronic device 300, depicting a first PCB 310 having a camera 312, a first keep-out zone 318, and a second keep-out zone 320. As shown in FIG. 3A, electronic device 300 may include a display panel 302 having a display area 304 and a peripheral area 306 abutting on a side of display area 304. In some examples, display area 304 and peripheral area 306 may be covered by a display layer (e.g., a front glass). Further, electronic device 300 may include an input assembly 308 disposed in peripheral area 306.

Input assembly 308 may include first PCB 310 and camera 312 disposed on first PCB 310. Furthermore, input assembly 308 may include a first microphone 314 and a second microphone 316 disposed on first PCB 310 on a right side and a left side, respectively, of camera 312.

Furthermore, input assembly 308 may include first keep-out zone 318 between first microphone 314 and display area 304. Also, input assembly 308 may include second keep-out zone 320 defined on first PCB 310 between second microphone 316 and display area 304. In an example, first keep-out zone 318 may be defined on first PCB 310 between first microphone 314 and display area 304, and second keep-out zone 320 may be defined on first PCB 310 between second microphone 316 and display area 304. In another example, first keep-out zone 318 may be defined between first PCB 310 and display area 304 below first microphone 314, and second keep-out zone 320 may be defined between first PCB 310 and display area 304 below second microphone 316.

Further, electronic device 300 may include a first antenna 322 and a second antenna 324 disposed in first keep-out zone 318 and second keep-out zone 320, respectively. For example, first antenna 322 may be a C-shaped PCB trace antenna and second antenna 324 may be an inverted-C shaped PCB trace antenna. Thus, examples described in FIG. 3A may enable additional antennas (i.e., first antenna 322 and second antenna 324) to be placed in peripheral area 306 (e.g., a top border area) by integrating the antennas onto first PCB 310 associated with input assembly 308, for instance, without changing a length of first PCB 310 in an X-direction (i.e., along a width of display panel 302).

Figure 3B:
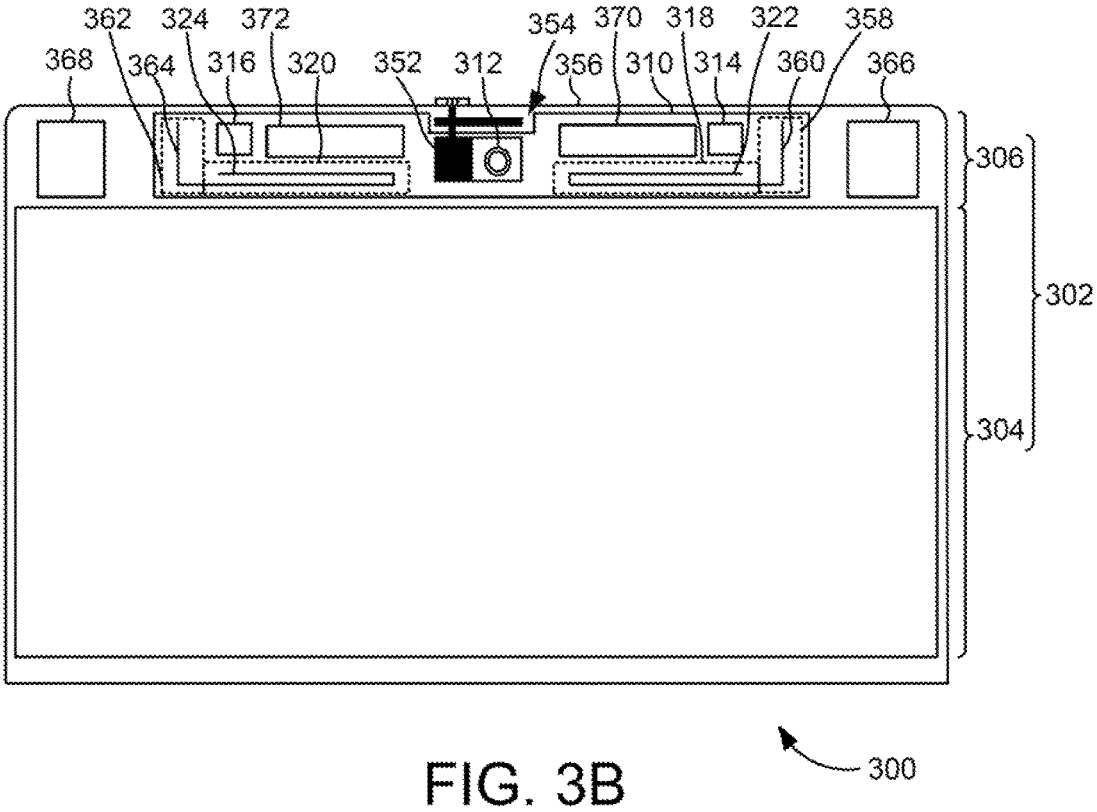
FIG. 3B is a cross-sectional front view of the example electronic device of FIG. 3A, depicting additional features.

FIG. 3B is a cross-sectional front view of example electronic device 300 of FIG. 3A, depicting additional features. For example, similarly named elements of FIG. 3B may be similar in structure and/or function to elements described with respect to FIG. 3A. As shown in FIG. 3B, electronic device 300 may include a slidable shutter 352 to open or close camera 312. In an example, first PCB 310 may include a recess portion 354 defined above camera 312. In this example, slidable shutter 352 may be mounted to a housing 356 of electronic device 300 in recess portion 354.

In some examples, since slidable shutter 352 is mounted to housing 356 above camera 312, an additional unused space may be created on a top side of first PCB 310. Examples described herein may utilize the unused space to extend first PCB 310. Further, extended first PCB 310 may then be used to rearrange the components (e.g., first microphone 314, second microphone 316, connectors, or the like) such that first PCB 310 can accommodate first keep-out zone 318 and second keep-out zone 320 on a left side and a right side of camera 312, respectively.

Further, first PCB 310 may include a first EMI shield 370 disposed between camera 312 and first microphone 314. Further, first PCB 310 may include a second EMI shield 372 disposed between camera 312 and second microphone 316. First EMI shield 370 and second EMI shield 372 may shield camera 312 from a radio frequency interference (RFI). In other examples, first EMI shield 370 and second EMI shield 372 may also be disposed around other components to shield the other components from the RFI.

Further, electronic device 300 may include a third keep-out zone 358 on a side of first microphone 314. Furthermore, electronic device 300 may include a first radiator 360 disposed in third keep-out zone 358 and connected to first antenna 322 to extend a size of first antenna 322, for instance, to realize a desired wavelength for first antenna 322.

Furthermore, electronic device 300 may include a fourth keep-out zone 362 on a side of second microphone 316. In an example, third keep-out zone 358 and fourth keep-out zone 362 may be defined on first PCB 310 or left and right side of first PCB 310, respectively. Also, electronic device 300 may include a second radiator 364 disposed in fourth keep-out zone 362 and connected to second antenna 324 to extend a size of second antenna 324, for instance, to realize a desired wavelength for second antenna 324.

By placing first antenna 322 and second antenna 324 on first PCB 310, electronic device 300 described herein may accommodate additional antennas in peripheral area 306. As shown in FIG. 3B, electronic device 300 may include a third antenna 366 and a fourth antenna 368 disposed in peripheral area 306 on a right side and a left side, respectively, of input assembly 308 (e.g., as shown in FIG. 3A).

Figure 4A:
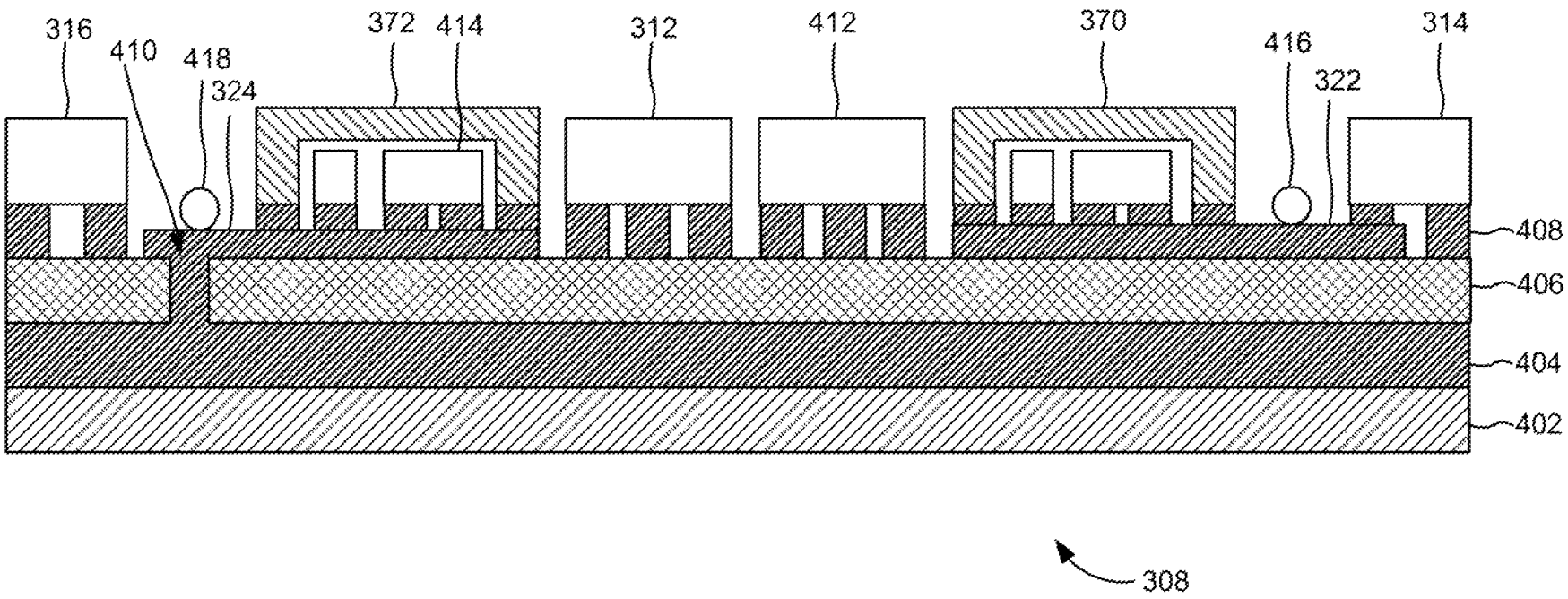
FIG. 4A is a cross sectional side view of the example input assembly of FIG. 3A, depicting different layers of the first PCB.

FIG. 4A is a cross sectional side view of example input assembly 308 of FIG. 3A, depicting different layers of first PCB 310 (e.g., as shown in FIG. 3A). For example, similarly named elements of FIG. 4A may be similar in structure and/or function to elements described with respect to FIG. 3A. As shown in FIG. 4A, first PCB 310 may include a base layer 402. Example base layer 402 may include a metal foil (e.g., a copper foil). For example, the copper foil may form continuous metal foil and may act as a conductor of first PCB 310. Base layer 402 may be an optional layer. Further, first PCB 310 may include a first metal layer 404 formed on base layer 402. Example first metal layer 404 may act as a ground layer of first PCB 310 to ground the electronic components or circuitry disposed on first PCB 310.

Furthermore, first PCB 310 may include a substrate 406 formed on first metal layer 404. Example substrate 406 may be a physical material that can hold traces and/or components disposed on first PCB 310. Also, first PCB 310 may include a second metal layer 408 formed on substrate 406. For example, second metal layer 408 may include the traces that can carry electrical signals to different components across first PCB 310. In the example shown in FIG. 4A, camera 312, first microphone 314, and second microphone 316, infrared sensor 412, and other components 414 (e.g., electronic circuitry) may be disposed on substrate 406 and electrically connected via second metal layer 408. Also, FIG. 4A depicts EMI shields 370 and 372 around the components (e.g., 414). Further, first antenna 322 and second antenna 324 may be disposed on substrate 406, for instance, below first microphone 314 and second microphone 316, respectively. Furthermore, first antenna 322 and second antenna 324 may be connected to respective antenna feeds.

In the example shown in FIG. 4A, first antenna 322 and second antenna 324 may be disposed on substrate 406. In an example, an antenna may be mechanically connected to substrate 406 and electrically connected to first metal layer 404 for instance, to enhance radiation. For example, as shown in FIG. 4A, second antenna 324 may be mechanically connected to substrate 406 and electrically connected to first metal layer 404, for instance, via an opening 410 defined in substrate 406. Further in the example shown in FIG. 4A, first antenna 322 may be disposed on substrate 406, for instance, without connecting to first metal layer 404. Further, coaxial cables 416 and 418 may be directly soldered to first antenna 322 and second antenna 324, respectively. Alternately, coaxial cables 416 and 418 may be soldered to first keep-out zone 318 and second keep-out zone 320, respectively.

Figure 4B:
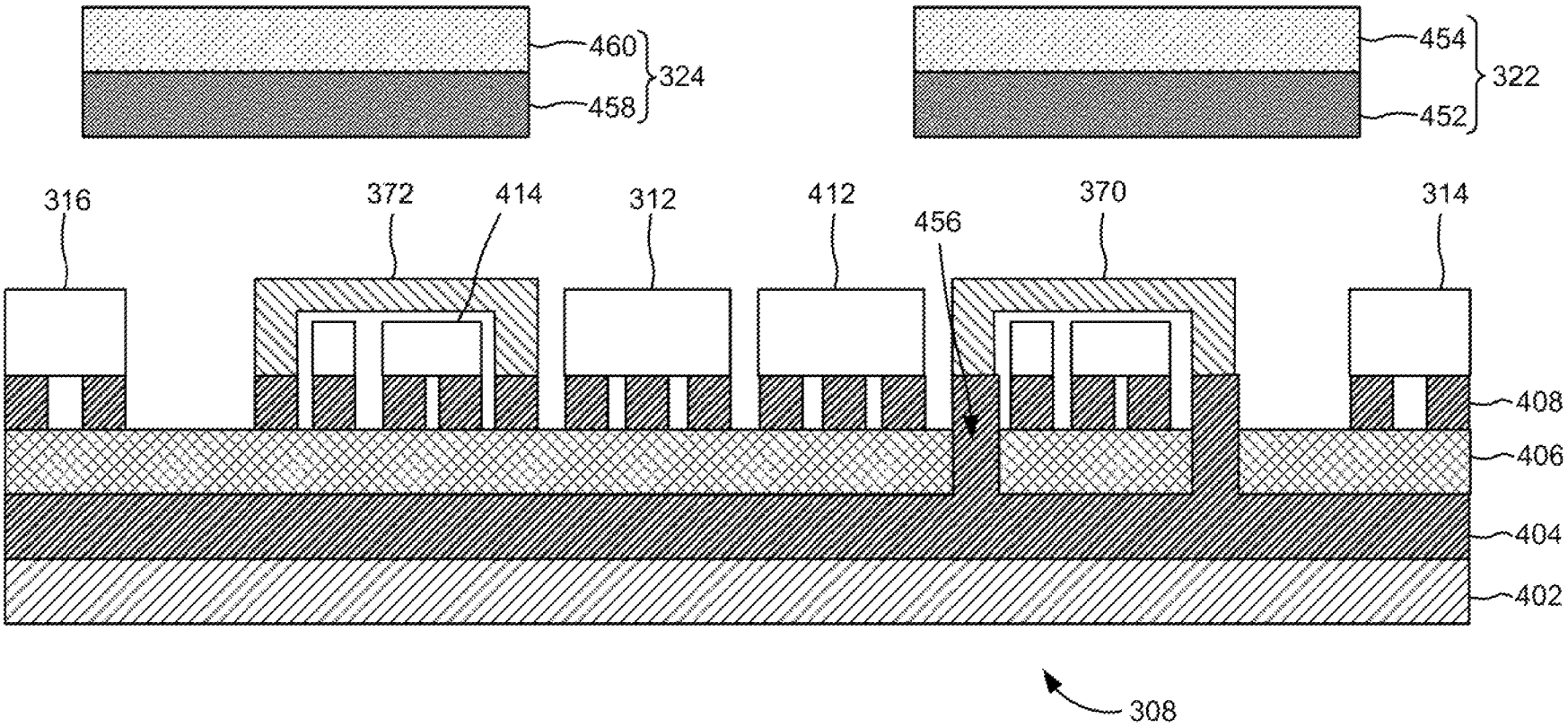
FIG. 4B is a cross sectional side view of the example input assembly of FIG. 4A, depicting additional features.

FIG. 4B is a cross sectional side view of example input assembly 308 of FIG. 4A, depicting additional features. In the example shown in FIG. 4B, first antenna 322 and second antenna 324 may be formed on different PCBs and then the PCBs may be disposed on substrate 406. In an example, first antenna 322 may include second PCB 452, and an antenna trace 454 formed on second PCB 452. Second PCB 452 may be disposed in first keep-out zone 318. In this example, second PCB 452 may be connected to first metal layer 404 for instance, via openings 456 defined in substrate 406 to enhance radiation. In another example, second antenna 324 may include a third PCB 458, and an antenna trace 460 formed on third PCB 458. Third PCB 458 may be disposed in second keep-out zone 320. In the example shown in FIG. 4B, a flexible printed circuit (FPC), flexible flat cable (FFC), PCB connector, stamping, or Laser Direct Structuring (LDS), or other conductive material can be used for coupling first antenna 322 or second antenna 324.

Figure 4C:
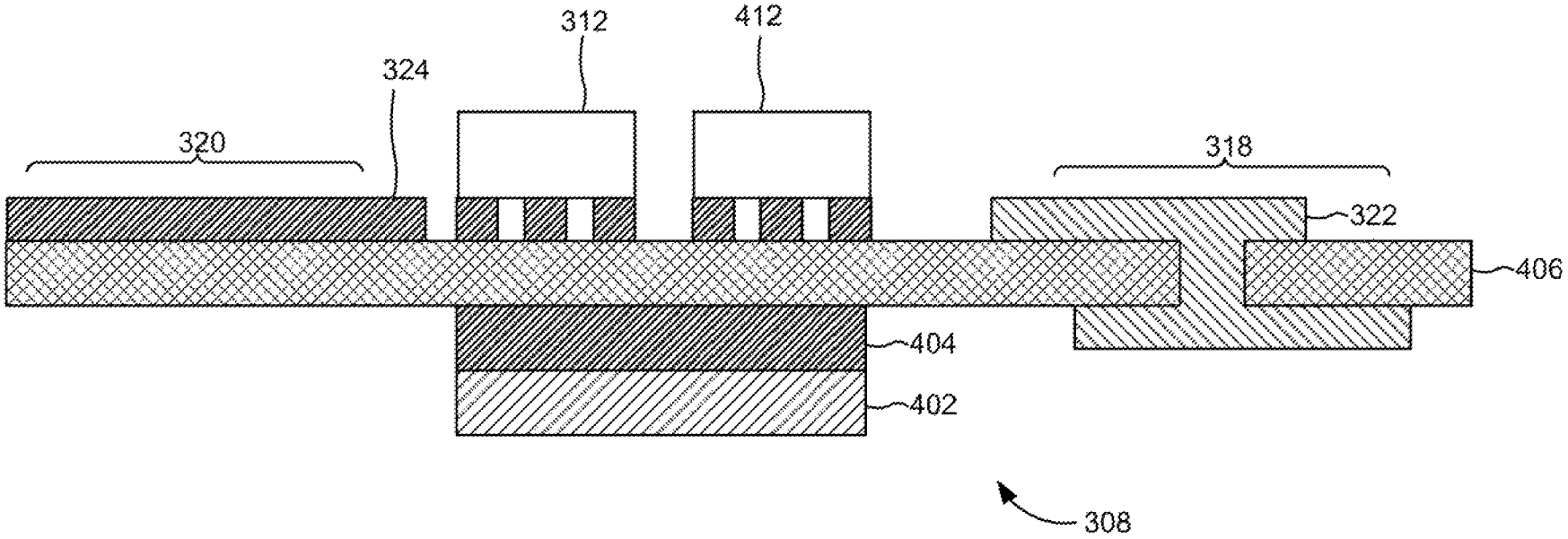
FIG. 4C is a cross sectional side view of the example input assembly of FIG. 4A, depicting the first keep-out zone and the second keep-out zone.

FIG. 4C is a cross sectional side view of example input assembly 308 of FIG. 4A, depicting first keep-out zone 318 and second keep-out zone 320. For example, similarly named elements of FIG. 4C may be similar in structure and/or function to elements described with respect to FIG. 4A. As shown in FIG. 4C, first keep-out zone 318 and second keep-out zone 320 may not include any copper traces or ground fill on any layer of first PCB 310.

Examples described herein may enhance specific absorption rate (SAR) performance since the antennas at a base housing are relocated to a top border area of a display housing. Examples described herein may also reduce a cost of implementing RFI mitigation solutions for the antennas at the base housing. By placing antennas in the display housing, examples described herein may support metal housings for electronic devices.

The above-described examples are for the purpose of illustration. Although the above examples have been described in conjunction with example implementations thereof, numerous modifications may be possible without materially departing from the teachings of the subject matter described herein. Other substitutions, modifications, and changes may be made without departing from the spirit of the subject matter. Also, the features disclosed in this specification (including any accompanying claims, abstract, and drawings), and/or any method or process so disclosed, may be combined in any combination, except combinations where some of such features are mutually exclusive.

The terms "include," "have," and variations thereof, as used herein, have the same meaning as the term "comprise" or appropriate variation thereof. Furthermore, the term "based on", as used herein, means "based at least in part on." Thus, a feature that is described as based on some stimulus can be based on the stimulus or a combination of stimuli including the stimulus. In addition, the terms "first" and "second" are used to identify individual elements and may not meant to designate an order or number of those elements.

The present description has been shown and described with reference to the foregoing examples. It is understood, however, that other forms, details, and examples can be made without departing from the spirit and scope of the present subject matter that is defined in the following claims.

What is claimed is:

1. An electronic device comprising:
- a housing;
- a display panel disposed in the housing;
- an input assembly disposed in the housing abutting a side of the display panel, wherein the input assembly comprises:
  - a printed circuit board (PCB);
  - a sensor disposed on the PCB; and
  - a first keep-out zone defined on the PCB on a side of the sensor,
  - wherein the PCB comprises an electromagnetic interference (EMI) shield disposed around the sensor to shield the sensor from a radio frequency interference (RFI); and
- an antenna disposed in the first keep-out zone of the PCB.

2. The electronic device of claim 1, wherein the sensor comprises a camera, a depth sensor, or a microphone.

3. The electronic device of claim 1, wherein the antenna is a PCB trace antenna or a patch antenna.

4. The electronic device of claim 1, further comprising:
- a second keep-out zone defined on the PCB; and
- a radiator disposed in the second keep-out zone and connected to the antenna to extend a size of the antenna.

5. The electronic device of claim 1, wherein the PCB comprises:
- a first metal layer;
- a substrate formed on the first metal layer; and
- a second metal layer formed on the substrate, wherein the sensor is disposed on the substrate and electrically connected via the second metal layer, and wherein the antenna is disposed on the substrate and connected to an antenna feed.

6. The electronic device of claim 1, wherein the antenna comprises a C shape or an inverted-C shape.

7. An electronic device comprising:
- a base housing; and
- a display housing connected to the base housing, wherein the display housing is to define an opening, and wherein the display housing comprises:
  - a display panel;
  - an input assembly, wherein the input assembly comprises:
    - a printed circuit board (PCB) abutting a side of the display panel;
    - a camera disposed on the PCB, wherein the camera comprises a lens that aligns with the opening; and
    - a keep-out zone defined on the PCB on a side of the camera;
  - a slidable shutter disposed between the display housing and the lens; and
  - an antenna formed in the keep-out zone.

8. The electronic device of claim 7, wherein the PCB comprises:
- a recess portion defined above the camera, wherein the slidable shutter is mounted to the display housing corresponding to the recess portion.

9. The electronic device of claim 7, wherein the slidable shutter comprises:
- a shielding portion to slide between a closed position that impedes light from passing through the opening and an open position that allows the light to pass through the opening; and
- a button portion slidably mounted in a shutter control opening of the display housing above the camera, wherein the button portion is to enable to move the shielding portion between the closed position and the open position.

10. The electronic device of claim 7, further comprising:
- a motherboard disposed in the base housing;
- a transceiver disposed in the base housing and connected to the motherboard;
- a connector disposed on the PCB to electrically connect the input assembly to the motherboard; and
- an antenna feed disposed on the PCB to electrically connect the antenna to the transceiver.

11. The electronic device of claim 7, wherein the input assembly comprises:
- an electronic component disposed on the PCB on a side of the camera, wherein the keep-out zone is defined on the PCB between the display panel and the electronic component.

12. An electronic device comprising:
- a display panel having a display area and a peripheral area abutting on a side of the display area;
- an input assembly disposed in the peripheral area, wherein the input assembly comprises:
  - a first printed circuit board (PCB);
  - a camera disposed on the first PCB; and
  - a first microphone and a second microphone disposed on the first PCB on a right side and a left side, respectively, of the camera;
- a first keep-out zone between the first microphone and the display area;
- a second keep-out zone between the second microphone and the display area; and a first antenna and a second antenna disposed in the first keep-out zone and the second keep-out zone, respectively.

13. The electronic device of claim 12, further comprising:

a slidable shutter to open or close the camera.

14. The electronic device of claim 13, wherein the first PCB comprises:

a recess portion defined above the camera, wherein the slidable shutter is mounted to a housing of the electronic device in the recess portion.

15. The electronic device of claim 12, wherein the first keep-out zone is defined on the first PCB between the first microphone and the display area, and wherein the second keep-out zone is defined on the first PCB between the second microphone and the display area.

16. The electronic device of claim 12, wherein the first keep-out zone is defined between the first PCB and the display area below the first microphone, and wherein the second keep-out zone is defined between the first PCB and the display area below the second microphone.

17. The electronic device of claim 12, wherein the first PCB comprises:

a base layer comprising a metal foil;

a first metal layer formed on the base layer;

a substrate formed on the first metal layer; and a second metal layer formed on the substrate, wherein the camera, the first microphone, and the second microphone are disposed on the substrate and electrically connected via the second metal layer, and wherein the first antenna and the second antenna are disposed on the substrate and connected to an antenna feed.

18. The electronic device of claim 12, wherein the first antenna comprises:

a second PCB; and an antenna trace formed on the second PCB, wherein the second PCB is disposed in the first keep-out zone.

19. The electronic device of claim 12, wherein the second antenna comprises:

a third PCB; and an antenna trace formed on the third PCB, wherein the third PCB is disposed in the second keep-out zone.

* * * * *